US009828303B1

(12) United States Patent
Gold

(10) Patent No.: US 9,828,303 B1
(45) Date of Patent: Nov. 28, 2017

(54) HIGH BRISANCE METAL POWDER EXPLOSIVE

(71) Applicant: Vladimir M. Gold, Hillside, NJ (US)

(72) Inventor: Vladimir M. Gold, Hillside, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 252 days.

(21) Appl. No.: 14/674,727

(22) Filed: Mar. 31, 2015

Related U.S. Application Data

(63) Continuation-in-part of application No. 14/540,292, filed on Nov. 13, 2014.

(60) Provisional application No. 61/903,437, filed on Nov. 13, 2013.

(51) Int. Cl.

| | |
|---|---|
| ***C06B 45/00*** | (2006.01) |
| ***C06B 45/04*** | (2006.01) |
| ***D03D 23/00*** | (2006.01) |
| ***D03D 43/00*** | (2006.01) |
| ***F42B 1/02*** | (2006.01) |
| ***F42B 25/00*** | (2006.01) |

(52) U.S. Cl.
CPC ..... *C06B 45/04* (2013.01); *F42B 1/02* (2013.01); *F42B 25/00* (2013.01)

(58) Field of Classification Search
USPC ..... 149/34, 2, 17, 108.2, 109.4, 109.6
See application file for complete search history.

(56) References Cited

U.S. PATENT DOCUMENTS 3,111,439 A * 11/1963 Brunauer ..... C06B 25/34 149/1

OTHER PUBLICATIONS

Helmich et al., Chem. Mater. 2010, 22, 4835-4837.*
Melmich et al., Chem. Mater. 2010, 22, 4835-4837.*

* cited by examiner

*Primary Examiner* — James McDonough
(74) *Attorney, Agent, or Firm* — Michael C. Sachs

(57) ABSTRACT

A very high brisance metal powder explosive is created by including a multitude of hollow aluminum/aluminum oxide micro-particle shells deposited within a high explosive composition matrix. The interior of such micro-particle shells may contain air, nitrogen, other gases, combinations thereof, or possibly even be a vacuum. The invention might be used on warheads that are fragmentation warheads, explosively formed penetrators, air blast warheads, shaped charge jets of shaped charge warheads, or other high explosive-driven devices.

7 Claims, 4 Drawing Sheets

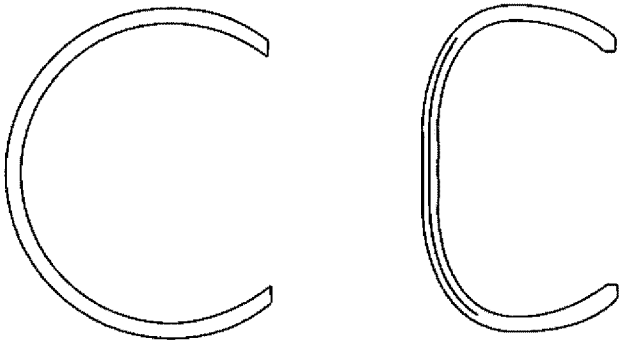
FIG. 4A
FIG. 4B
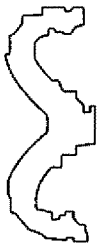
FIG. 4C
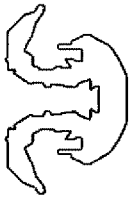
FIG. 4D
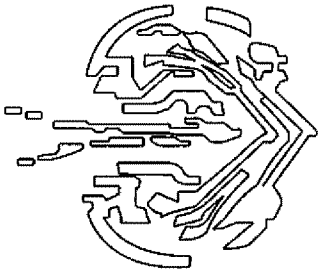
FIG. 4E

HIGH BRISANCE METAL POWDER EXPLOSIVE

CROSS REFERENCE TO RELATED APPLICATIONS

This application is a continuation-in-part of application Ser. No. 14/540,292 filed Nov. 13, 2014, of same title and same inventor, which in turn claims benefit under 35 USC 119(e) of provisional application 61/903,437 filed Nov. 13, 2013, the entire file wrapper contents of which applications are hereby incorporated as though fully set forth.

U.S. GOVERNMENT INTEREST

The inventions described herein may be made, used, or licensed by or for the U.S. Government for U.S. Government purposes.

BACKGROUND OF INVENTION

This invention relates to a very high brisance metal powder explosive and more particularly, to a high energy, high energy-rate-release insensitive high-explosive composition.

The military constantly seeks more powerfully explosive warheads. The addition of aluminum to increase the performance of explosives was patented by Roth in 1900 (G. Roth, German patent 172,327 (1900)). According to Lheure (L. Lheure, MP 12,125(1903-1904)), the leader of Austria in 1901 proposed to the French government the use of aluminum in explosives. Historically, aluminum containing explosives, or aluminized explosive compositions, such as ammonal (ammonium nitrate/trinitrotoluene/aluminum powder/charcoal 65%/15%/17%/3%) was used by the military since World War I, in particular by Austrians, Germans, and to lesser extent by the French. Notwithstanding satisfactory performance of aluminized explosives, they were not used much as long as the quantity of aluminum on the market was limited and its cost much higher than of any other ingredient in the explosive composition. When these drawbacks were overcome sometime after WWI, more and more aluminized explosives started to be used not only for military purposes but also as industrial explosives. In World War II, aluminized explosive compositions were widely used by all the belligerent nations for incendiary and enhanced blast bombs especially in underwater ammunitions such as mines, torpedoes, depth charges, etc., where they were found to be most effective. In the 1970's, 1990's, and 2000's there was a renewed interest in developing metalized CHON (carbon-hydrogen-oxygen-nitrogen) explosive compositions using other metal powder additives such as magnesium, silicon, boron, and other high oxidation-reaction-heat metals. The action of aluminum in explosives was investigated by many researchers and it had been claimed that aluminum does not take part in the actual detonation but reacted immediately afterward with the products of explosion such as $CO_2$ and $H_2O$. For illustration:

$$2Al+3CO_2 \rightarrow Al_2O_3,+3CO+196 \text{ kcal/mol}$$

$$2Al+3H_2O \rightarrow Al_2O_3+,3H_2,+226 \text{ kcal/mol}$$

The large amounts of heat liberated by these reactions maintain a high pressure of explosion for a longer period of time than would be obtained without aluminum. The pressure-time curves of explosions containing aluminum do not have such high "peaks" as do the corresponding non-aluminized explosives but the pressures remain high, lasting 2-3 times as long. Researchers have shown that aluminum reacts not only with oxygen but also with nitrogen forming a nitride. For illustration:

$$Al+N \rightarrow AlN+80 \text{ kcal/mol}$$

This means that it would not be necessary to make aluminized explosives with a positive oxygen balance, as was done prior and during WWI, but it is better to maintain some negative balance. Currently, industry and the military have used aluminized/metalized explosives which are comprised of solid, or more or less solid, particles of explosive substances and/or of solid particles of metals. The explosives of this invention explore use of hollow type particles instead. Better capabilities are proposed for explosives of this invention using hollow type particles.

BRIEF SUMMARY OF INVENTION

A very high brisance metal powder explosive of this invention is created by including a multitude of hollow, (as opposed to essentially solid), aluminum (or other suitable metal) micro-particles, deposited within a high explosive composition matrix. The interior of such micro-particles may contain air, nitrogen, other gases, combinations thereof, or possibly even be a vacuum. The micro-particles have a solid skin of defined thickness, which may be made of aluminum or other metals such as lithium, boron, magnesium, titanium, beryllium, or a combination of aluminum and such other metals. When such explosive is detonated, the resulting detonation products act to collapse the hollow aluminum (or other suitable metal) micro-particles, forming a multiplicity of high velocity nano/micro-fragments nano/micro-jets, and sub-particle debris, promoting fast aluminum/metal oxidation reaction, and, thereby, tremendously increasing the power of such explosive. The invention might also be used in industry for rock blasting application, mining, explosive welding, earth drilling, or on warheads that are fragmentation warheads, explosively formed penetrators, air blast warheads, shaped charge jets of shaped charge warheads, or other high explosive-driven devices.

OBJECTS OF THE INVENTION

Accordingly, it is an object of the present invention to provide a very high brisance metal powder explosive which may be used for industrial applications, in fragmentation warheads, explosively formed penetrator warheads, air blast warheads, shaped charge jets of shaped charge warheads, or in other high explosive-driven devices.

Another object of the present invention is to provide a very high brisance metal powder explosive comprising a multitude of hollow aluminum/aluminum oxide micro-particles, deposited within a high explosive composition matrix.

It is a further object of the present invention to provide micro-particles, deposited within a high explosive composition matrix, wherein the interior of such micro-particles may contain air, argon, nitrogen, other gases, combinations thereof, or possibly even be a vacuum.

It is a still further object of the present invention to provide more powerful and safer explosives for lighter, more lethal and safer ammunitions. Employing the hollow aluminum/metal micro-particle technology of this invention can increase both "metal pushing" and the "air-blast" power found in state-of-the-art aluminized/metalized explosives by as much as 30%, provided that the aluminum/metal additive can be vaporized at the vicinity of, or near the explosive detonation wave front. Such aluminum vaporization condition can be attained through a series of processes including initial/secondary shock, plastic/deformation work, fragmentation, Joule-heating at the detonation wave front, or by electromagnetic inductive heating, along with the conventional direct heat input from detonation products and/or from the liquid/solid aluminum oxidation reaction, common for such state-of-the-art aluminized explosives.

LIST OF DRAWINGS

FIG. 4A-4E show a cross-sectional view by hydro-code analyses of the collapse of a hypothetical hollow micro-particle, at progressive stages of time, a) through e), according to this invention.

DETAILED DESCRIPTION

According to current state-of-the-art aluminized explosive technology, common aluminum micro-particle shapes employed are usually solid spheres, spheroids, ellipsoids, or thin flakes.

Figure 1:
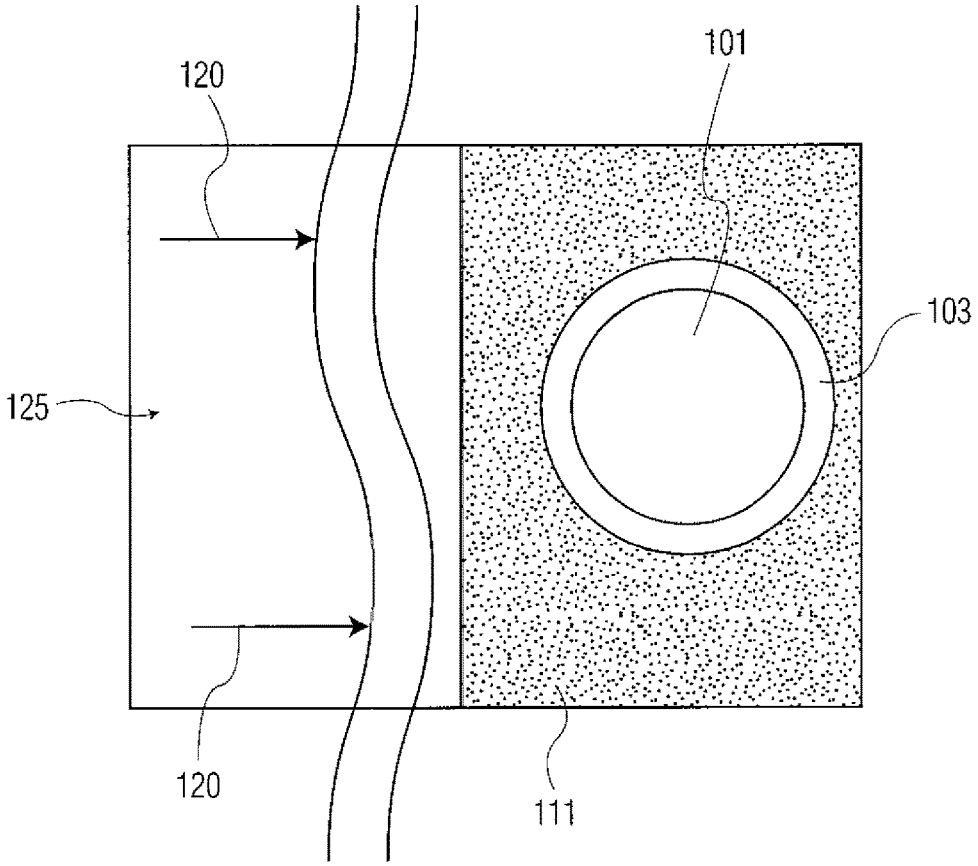
FIG. 1 shows a cross-sectional view of a solid micro-particle in a conventional explosive before the detonation wave passes over the particle.

FIG. 1 shows a schematic of a cross-sectional view of an idealized solid aluminum micro-particle 101 before a detonation wave front (such as 120) passes over it. A multiplicity of micro-particles such as 101 are compacted in a matrix 111. Wave front 120 may be activated by detonating explosives such as 125. The surface of each micro-particle 101 is covered with a thin layer 103 of aluminum oxide ($Al_2O_3$). $Al_2O_3$ is a byproduct of a chemical reaction between aluminum and water vapor and/or oxygen from air and is normally present at the surface, preventing further oxidation of the aluminum. Aluminum oxide is responsible for the resistance of metallic aluminum to weathering. Metallic aluminum is very reactive with atmospheric oxygen, and a thin passivation layer of aluminum oxide (4 nm thickness) usually forms on any exposed aluminum surface. Normally only a few atomic spacings thick, with a melting temperature of approximately 2,345° K and a boiling point of 3,250° K, an $Al_2O_3$ layer is an extremely effective "natural insulation" preventing chemical reaction between chemically active species of the detonation products and the aluminum at the detonation wave front. $Al_2O_3$ is an electrical insulator but has a relatively high thermal conductivity (30 $Wm^{-1}K^{-1}$) making possible transmission of heat from detonation products to the aluminum inside, (thermal conductivity of aluminum is 237 $Wm^{-1}K^{-1}$).

Figure 2:
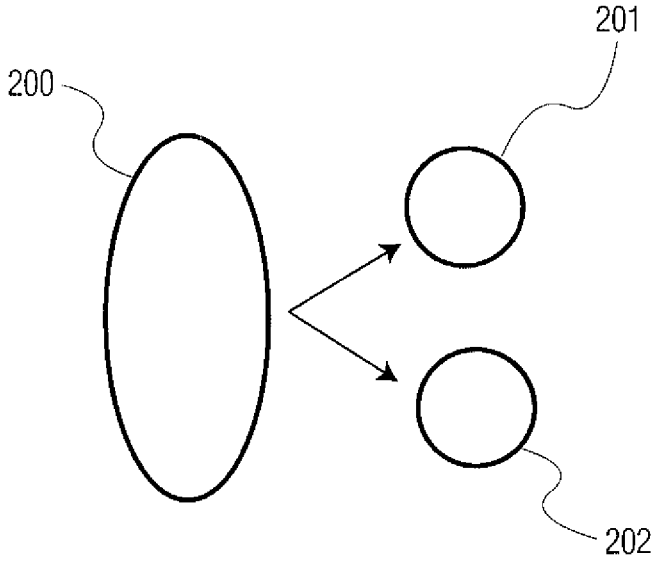
FIG. 2 shows a cross-sectional view of a solid micro-particle in a conventional explosive after the detonation wave had passed over the particle.

FIG. 2 is a cross-sectional view of the solid micro-particle after the detonation wave front has passed over it and the particle is projected forward and then surrounded by detonation products, now in the "tail" of the expansion/reaction wave 120. Under action of the detonation wave pressures, micro-particle 101 deforms and changes its shape into a shape similar to that of 200. With changes of the particle shape, the surface area of the particle and aluminum oxide layer 103 expand or contract, resulting in a series of surface "cracks", fractures, or "breaks". Once parts of the aluminum oxide surface layer 103 break, detonation products species can access atoms of aluminum underneath the surface to react with the aluminum at the fracture sites. However, since parts of the remaining $Al_2O_3$ skin continue to block passage of the detonation products species, the bulk of the aluminum micro-particle rests unreacted. Accordingly, given that the aluminum oxide layer melting temperatures are relatively high, to permit access of the detonation products species to the aluminum, the bulk of the aluminum particle has to be either melted or fragmented.

One of the possible physical mechanisms for heating aluminum micro-particles is through detonation wave shock-compression. Analyses of the shock interaction of a detonation wave front with an aluminum particle show that for detonation pressure ranges achieved in conventional state-of-the-art explosives, solid micro-particles are shock-heated to temperatures of approximately 600-650° K, which is significantly below the melting point of the aluminum of 934° K. Nevertheless, there is an abundant aluminized explosive calorimetry experimentation data suggesting that for the properly formulated compositions almost the entirety of the aluminum is consumed in an explosion. If the shock-heating alone cannot melt and fragment the aluminum micro-particles, one may ask why does the aluminum react.

Another possible mechanism for heating and melting aluminum micro-particles is through a relative "slow" heat input from the surrounding "hot" detonation products, both from direct molecular collisions with the $Al_2O_3$ skin and by radiation. As mentioned before, relatively high thermal conductivity of the aluminum oxide makes this feasible. As shown in FIG. 2, as a micro-particle moves through, and with, the detonation products expansion wave 120, under combined action of heat supplied by the detonation products and heat produced by the aluminum oxidation reactions at the aluminum oxide skin fracture sites, an originally solid particle will "gradually" soften and melt. Once a micro-particle melts, and having no or little shear deformation resistance, the particle can easily split forming a multiplicity of liquid aluminum sub-particles (201, 202, e.g.). Accordingly, assuming an ideal spherical-particle shape, each "split" of one micro-particle into two or more sub-particles should result in an increase of the surface area by approximately 26% or more, stretching and fracturing the $Al_2O_3$ skin, and giving more and more access of the detonation products species to the aluminum. Therefore, for properly formulated state-of-the-art aluminized explosive compositions, the increase of the particle cumulative surface area will eventually result in complete reaction of the entire aluminum. The large amounts of heat liberated in the aluminum oxidation reactions allow the explosion "bubble" to maintain higher pressures in the detonation products expansion wave for longer periods of times. These properties are extremely useful for the "enhanced blast" effect in rock blasting, in the air, in water, in terrain, or in marine structure attack applications.

An object of this invention is to extend the enhanced "air-blast" power of the state-of-the-art aluminized/metalized explosive compositions to that of the "metal pushing" power. This requires extremely fast aluminum oxidation reaction rates, in the vicinity of or very close to the detonation wave front.

Figure 3:
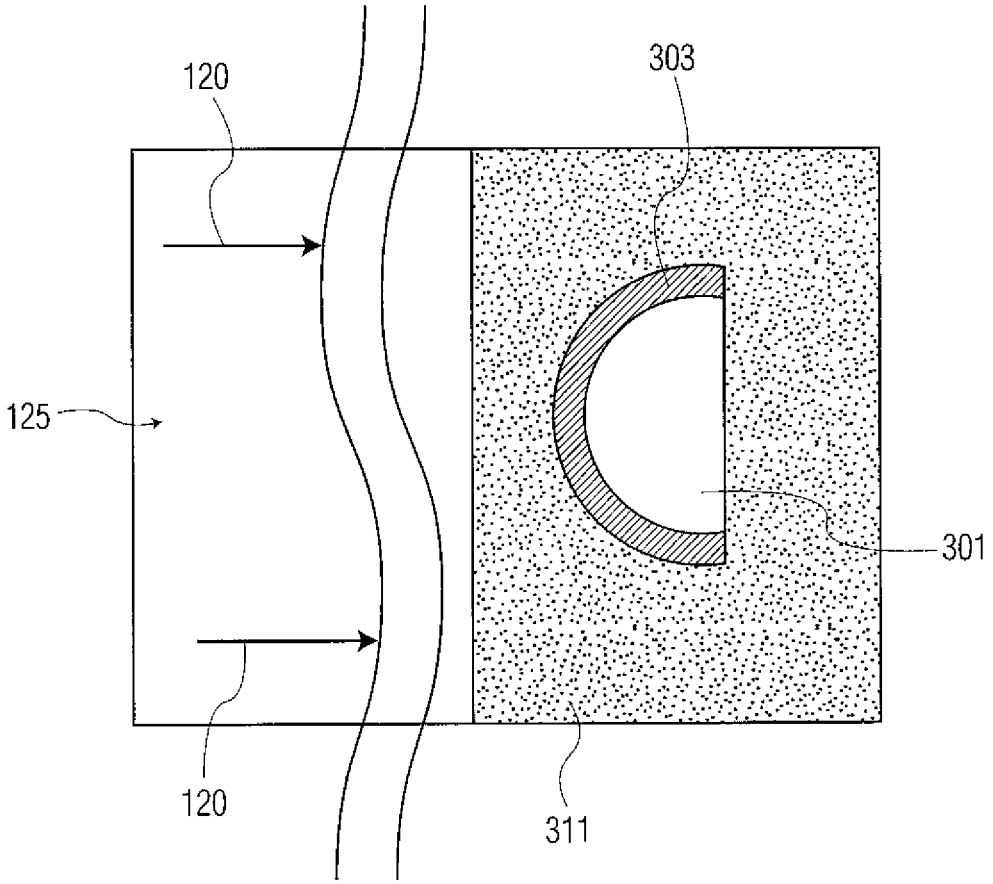
FIG. 3 shows a cross-sectional view of a hollow micro-particle according to this invention, before the detonation wave passes over the particle.

FIG. 3 shows a cross sectional view of a hollow micro-particle according to this invention. In FIG. 3, a vacuum, air, nitrogen, other gasses, or combinations thereof fills the hollow interior of a micro-particle 301 having a solid skin 303 of defined thickness. The skin is made of aluminum, of other metals, or of a combination of aluminum and such other metals. The surface of the aluminum particle is covered with a thin layer of aluminum oxide ($Al_2O_3$), several atomic spacings thick, normally present at the surface of solid-state metallic aluminum at ambient temperatures and pressures. As mentioned, the micro-particle hollow interior may be filled with $N_2$ (nitrogen) gas, air, or be essentially a vacuum, if permitted by the strength of the aluminum shell and that of the compacted matrix 311. The fabrication might be done in a vacuum, in air, or in an environment of argon or nitrogen, e.g., so that the compacted matrix 311 of such micro-particles might include such respective gases, e.g. The micro-particle 301 may be a hollow sphere of predetermined diameter and thickness, or it might be of some other closed or open geometrical shape such as spheroid, ellipsoid, polyhedron, or another shape. As shown, a plurality of such micro-particles may lay in the highly compacted matrix 311. When the high explosive 125 in this embodiment is detonated, it creates a detonation wave front 120 that propagates through explosive matrix 311, leading to explosively-driven collapse of the plurality of micro-particle shells 301. Beyond this wave front 120, both the detonation products and the products of collapse of the plurality of microparticles 301 rapidly advance within the expansion wave 120 in random directions or in a preferred predetermined direction, if so designed, for example. As the detonation wave front advances into the un-reacted material, the detonation products act to collapse yet further hollow aluminum (or other suitable metal) micro-particles. These in turn form a multiplicity of high velocity nano/micro-fragments, nano/micro-jets, and sub-particle debris. Such multiplicity of micro-jets and particle debris move in the detonation product expansion/reaction wave, possibly colliding with each other, while continuing to break-up and fragment. All the above result in manifold increases to the aluminum/metal particle surface areas, along with substantial growth in the surface and bulk temperatures, ultimately leading to thermodynamic solid-to-liquid state phase changes, or to that of solid-to-vapor, preferably. In addition, because the aluminum (or other suitable metal) particles continuously deform, fracture, and rapidly move with respect to the detonation products, the relative concentrations of the reactive detonation products species and un-reacted surface aluminum (or other suitable metal) is significantly greater compared to that of an ordinary solid (non-hollow) particle configuration, all promoting fast aluminum/metal oxidation reactions. In addition to "pure" shock/detonation wave compression and the heat from the aluminum oxidation reaction, resulting sub-particle fragments will also be heated due to plastic work-heating effect, fracturing, high velocity collisions with the detonation products and with the multiplicity of sub-particle debris. Achievement of a superheated liquid or vapor thermodynamic states may even be feasible. Further, in contrast with conventional aluminized/metalized compositions, because a substantial increase in time rate of these aluminum/metal oxidation reactions is expected, the oxidation reaction heat will not escape as "heat", but will be captured into the detonation product mechanical "PdV" work. This heat will eventually be transmitted instead into kinetic energy of the warhead case fragments, or/and EFPs (Explosive Formed Projectiles) and SCJ (Shaped Charge Jets), or/and airbiast explosion devices, if used instead. Employing this hollow aluminum/metal micro-particle technology is expected to increase both "metal pushing" and "air-blast" power of state-of-the-art aluminized/metalized explosives by as much as 30%, provided that the aluminum/metal additive is vaporized at the vicinity of, or near the explosive detonation wave front. The invention might be used on warheads that are fragmentation warheads, explosively formed penetrators, air blast warheads, shaped charge warheads, or other high explosive-driven devices.

FIGS. 4A through 4E show results of three-dimensional axi-symmetric analyses of explosively driven collapse (of a micro-particle as shown in FIG. 4A, in a representative 15-micron diameter, 1.075 thick spherical aluminum shell, initially deposited within an ideally homogeneous matrix of high explosive composition, and detonated at time zero. The wave front moves from left to right in this series of pictures 4A through 4E. Although the micro-particles are shown here oriented as convex in the direction of the wavefront, they may have different orientations, whether randomly, or all as a group. The analyses was conducted by R. Mudry and W. Davis of US Army ARDEC employing an ALE3D computer program (The ALE3D Team, A. L. Nichols, etc., "An Arbitrary Lagrange/Eulerian 2D and 3D Code System" LLNL Report LLNL-SM-404490, Aug. 14, 2009), which models collapse of this shell under adiabatic and approximately isentropic assumptions. That is, the heat transport from detonation products into aluminum and the heat created in the aluminum oxidation reactions had been neglected. Plots shown in FIG. 4 represent temperatures achieved in the aluminum only due to shock compression and plastic work. That is, the analyses represent the estimate of the low bound of the aluminum micro-particle temperatures attainable/feasible. Temperatures achieved in the explosive detonation products are accounted for by thermodynamic equation of state employed, but excluded from the plots for clarity.

As shown in FIG. 4A, initial interaction of the detonation shock wave front with the (convex side) of this aluminum micro-particle shell leads to shock-compression-heating of the aluminum to maximum temperatures in the order of 600° K. Accordingly, given that the melting temperature of aluminum at the ambient conditions is approximately 934° K and that the solid-to-fluid phase transition temperatures usually somewhat increase with pressures, the detonation wave shock compression of the aluminum micro-particle is not likely to produce melting. Furthermore, once the high pressures in shock-compressed aluminum are released by the stress rarefaction waves from the inner surface, the maximum temperatures rapidly drop down to approximately 480° K, as present in the temperature plot of FIG. 4B. Thereafter, as the aluminum micro-shell structure collapses and stretches, and, as the cumulative plastic work transforms into the heat, the temperatures in the aluminum raise back to 600° K, at time $t=8.3\times10^{-3}$ microseconds (FIG. 4C), and then up to 1,200° K, at time $t=9.2\times10^{-3}$ microseconds (FIG. 4D). As shown in these Figures, the shape of the collapsed micro-shell micro-particle is similar to that of typical forward-forming EFPs (Explosively Formed Projectiles), but only on this micro-scale. It is also interesting to note that, as the aluminum impacts and penetrates the relatively dense body of the detonation products, there is a localized temperature rise in the vicinity of the "micro-EFP's" mushroom head. As shown in FIG. 4D, based on the analyses, the secondary-shock-compressed aluminum can be heated to temperatures in the order of approximately 2,200° K. As the bulk of the aluminum moves in the direction of the detonation wave, the micro-EFP stretches and fragments. This generates a multiplicity of sub-fragment debris, further raising temperatures to approximately 1,200-1,600° K (see FIG. 4E). Note that the shape of FIG. 4E actually is made up of a plurality of fragments, though maybe appearing here seeming as a whole shape. Given that this represents a rather conservative estimate of the low bound of the temperatures attainable, the analyses strongly suggest the feasibility of vaporization of the aluminum in the vicinity of the detonation wave front (aluminum boiling temperature at ambient condition is approximately 2,790° K).

The hollow micro-particle shells may be fabricated through a number of technologies including CAFS (Chemical Aerosol Flow Synthesis Technology); see e.g., Helmich and Suslik, Chem. Mater., 22, 4835-4837, 2010, or through depositing aluminum onto commercially available polystyrene micro-beads in a fluidized bed arrangement, and then slow cooking off the polystyrene so that the net shape left after it volatilizes is similar to the micro-shell "C" shape desired (see FIG. 4A). Another method of fabricating these micro-particles can be through a high velocity impact of aluminum/metal micro-particles carried by colliding high speed argon or nitrogen gas flows. As was mentioned, the warheads made with this invention may be used in SC shaped charge warheads, EFP (explosively formed projectile) warheads, air blast warheads, or other high explosive-driven devices.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A high brisance aluminum powder explosive comprising a multiplicity of hollow metal micro-particle shells deposited within a highly compacted matrix, wherein the micro-particle shells are incompletely closed spheres with one part of the micro-particle shell left open, whereas an explosive wavefront is made to strike convex surfaces of the shells at fully intact locations thereon.

2. The explosive of claim 1, wherein the micro-particles are 300 nm in diameter and 25 nm skin thickness.

3. The explosive of claim 2 wherein the shells are aluminum oxide.

4. The explosive of claim 2 used in a shaped charge fragmentation warhead.

5. The explosive of claim 3 used in an explosively formed projectile fragmentation warhead.

6. The explosive of claim 4 used in an air blast warhead.

7. The explosive of claim 1, wherein the micro-particles comprise C-shape shells.

* * * * *